US010001267B2

(12) United States Patent
Ebner

(10) Patent No.: US 10,001,267 B2
(45) Date of Patent: Jun. 19, 2018

(54) LED MODULE AND LIGHTING ASSEMBLY HAVING A CORRESPONDING MODULE

(71) Applicant: ZUMTOBEL LIGHTING GMBH, Dornbirn (AT)

(72) Inventor: Stephan Ebner, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 180 days.

(21) Appl. No.: 14/773,495

(22) PCT Filed: Mar. 5, 2014

(86) PCT No.: PCT/EP2014/054240
§ 371 (c)(1),
(2) Date: Sep. 8, 2015

(87) PCT Pub. No.: WO2014/135577
PCT Pub. Date: Sep. 12, 2014

(65) Prior Publication Data

US 2016/0178177 A1 Jun. 23, 2016

(30) Foreign Application Priority Data

Mar. 5, 2013 (DE) ..... 10 2013 203 728

(51) Int. Cl.

| | |
|---|---|
| ***F21K 9/60*** | (2016.01) |
| ***F21V 29/10*** | (2015.01) |
| ***H05B 33/08*** | (2006.01) |
| *F21K 9/00* | (2016.01) |
| *F21V 5/00* | (2018.01) |
| *F21Y 105/12* | (2016.01) |
| *F21Y 105/10* | (2016.01) |
| *F21Y 115/10* | (2016.01) |

(52) U.S. Cl.
CPC ..... *F21V 29/10* (2015.01); *F21K 9/60* (2016.08); *H05B 33/0821* (2013.01); *F21K 9/00* (2013.01);
(Continued)

(58) Field of Classification Search
CPC ..... F21V 5/00; F21V 29/10; H05B 33/0821; F21K 9/60; F21K 9/00
(Continued)

(56) References Cited

U.S. PATENT DOCUMENTS 8,081,271 B2 * 12/2011 Kobayashi ..... G02F 1/133603 349/64
8,111,371 B2 * 2/2012 Suminoe ..... G09G 3/3426 349/1
(Continued)

FOREIGN PATENT DOCUMENTS

CN 202402975 8/2012
DE 202008007862 8/2008
(Continued)

OTHER PUBLICATIONS

International Search Report for PCT/EP2014/054240, English translation attached to original, Both completed by the European Patent Office dated Dec. 1, 2014, All together 7 Pages.

*Primary Examiner* — Bao Q Truong
*Assistant Examiner* — Arman B Fallahkhair
(74) *Attorney, Agent, or Firm* — Brooks Kushman P.C.

(57) ABSTRACT

An LED module having an arrangement of electronically connected LEDs and a carrier for the LEDs, wherein a parallel connection of series circuits of LEDs is present. The parallel connection is selected in such a manner that the thermal load on the carrier caused by the operation of the LEDs is distributed substantially evenly across the carrier.

4 Claims, 2 Drawing Sheets

(52) U.S. Cl.
CPC ..... *F21V 5/00* (2013.01); *F21Y 2105/10* (2016.08); *F21Y 2105/12* (2016.08); *F21Y 2115/10* (2016.08)

(58) Field of Classification Search
USPC ..... 362/237, 249.02, 294
See application file for complete search history.

(56) References Cited

U.S. PATENT DOCUMENTS

| | | | | |
|---|---|---|---|---|
| 8,421,362 | B2 * | 4/2013 | Kato | G02F 1/133603 315/169.3 |
| 8,970,131 | B2 * | 3/2015 | Brandes | H05B 33/0803 315/185 R |
| 9,019,445 | B2 * | 4/2015 | Shimizu | G02F 1/133603 349/65 |
| 2006/0044803 | A1 | 3/2006 | Edwards | |
| 2006/0255753 | A1 | 11/2006 | Sawada et al. | |
| 2010/0020267 | A1 | 1/2010 | Kobayashi et al. | |
| 2011/0260647 | A1 | 10/2011 | Catalano et al. | |
| 2011/0316009 | A1 | 12/2011 | Fukasawa | |

FOREIGN PATENT DOCUMENTS

| | | |
|---|---|---|
| EP | 2634480 | 9/2013 |
| JP | 2012043700 | 3/2012 |
| WO | 2007136020 | 11/2007 |

* cited by examiner

LED MODULE AND LIGHTING ASSEMBLY HAVING A CORRESPONDING MODULE

CROSS-REFERENCE TO RELATED APPLICATION

This application is the U.S. national phase of PCT Application No. PCT/EP2014/054240filed on Mar. 5, 2014, which claims priority to DE Patent Application No. 10 2013 203 728.7filed on Mar. 5, 2013, the disclosures of which are incorporated in their entirety by reference herein.

The present invention relates to an LED module in accordance with the preamble of claim 1, which LED module consists of an arrangement of electronically interconnected LEDs and a carrier for the LEDs, and to an arrangement for light emission comprising such an LED module.

The basis for the present invention is the at present conventional interconnection of LEDs on circuit boards to form series and parallel circuits. A parallel circuit formed by an arbitrary number of LED series circuits is preferably chosen in this case. In particular, in the present case, carrier circuit boards are considered which are planar and on which the LEDs are arranged in a uniform grid. Such an arrangement is used at the present time in order to operate LEDs with low current demand efficiently from conventional high-voltage converters. Normally, within such interconnections here the same number of LEDs is interconnected in all the parallel series circuits or strings.

In the case of LED modules provided for lighting purposes and configured in the manner described above, during operation a not inconsiderable heat is generated by the LEDs and should be dissipated efficiently in order to reduce the thermal loading of the LEDs or to keep the latter in an envisaged temperature range and thus to prolong their lifetime. By way of example, metal-core circuit boards are therefore used, which are coupled to corresponding heat sinks, if appropriate, via which the heat can then be dissipated.

However, even with use of these measures for heat dissipation, the thermal loading of the carrier and in particular of the LEDs arranged thereon is of varying magnitude. In the case of a customarily provided uniform equidistant arrangement of the LEDs on a circuit board, in general the heat is dissipated via the edge regions or end regions of a primarily elongate LED circuit board significantly more effectively than via the central or middle region. On account of this imbalance, the LEDs from the central region have to be cooled better or the cooling measures have to be designed more effectively, which entails a higher outlay.

Accordingly, the present invention is based on the object of distributing the thermal loading for LEDs on a circuit board more uniformly without disturbing the uniform arrangement of the LEDs or having to make the cooling in the center more efficient. This object is achieved according to the invention by means of the subjects specified in the independent claims. Particular embodiments or advantageous developments of the invention are specified in the dependent claims.

The invention therefore provides an LED module comprising an arrangement of electronically interconnected LEDs in parallel circuits formed by series circuits of the LEDs and a carrier or a circuit board provided as a carrying structure for the LEDs, wherein the parallel circuit is chosen such that the thermal loading caused by the operation of the LEDs is distributed substantially uniformly over the carrier.

The design of the LED interconnection according to the invention, which compensates for the imbalance in the thermal loading present in the case of LED modules from the prior art, can be realized in various ways.

In this regard, in a first exemplary embodiment, a targeted asymmetrical parallel interconnection of the LED series circuits or LED strings is provided, wherein, however, despite everything the LEDs are preferably arranged on a two-dimensional uniform grid situated on a circuit board. This asymmetrical interconnection is characterized in that the number of LEDs in a string which is situated in the edge region of the carrier or of the circuit board is reduced compared with the number of LEDs in a string from the central region. This means that more series circuits are found in the edge region of the circuit board than in the center or in the central region of the circuit board, even though the arrangement of the LEDs as seen overall is uniform or homogeneous. The difference in the number of LEDs in the individual strings furthermore has the consequence that the LEDs in the center or in the central region are now subjected to a lower current load and thus produce less heat. This takes account of the fact that the heat in the middle or more central region of the module can be dissipated less effectively to the surroundings or cooling elements coupled to the module, such that ultimately, as seen overall, there is a significantly more uniform thermal loading as seen across the area. Furthermore, in this exemplary embodiment, all the LEDs on the circuit board are substantially identical.

In a second exemplary embodiment, however, in contrast to the first exemplary embodiment, LEDs having different forward voltages are used. In this case, each series circuit or each string has LEDs having substantially identical forward voltages, but these forward voltages differ between strings from an edge region and a central region, such that ultimately the LEDs in a central region of the module are once again subjected to a smaller current load.

Furthermore, in this exemplary embodiment, each string preferably has an identical number of LEDs, although it would be readily possible to combine both exemplary embodiments for the purposes of the problem solution according to the invention. In this case, the LED strings would then differ not only with regard to the LEDs but also with regard to the number of LEDs.

Furthermore, a further usable effect in both exemplary embodiments can reside in a targeted amplification of luminous fluxes at the edge region of the LED modules. Particularly in the case of a planar arrangement of a multiplicity of LED modules according to the invention in combination with diffuse optical systems, this can lead to a higher homogeneity of the luminances on a light exit surface.

The invention is explained in greater detail below on the basis of a plurality of exemplary embodiments and with reference to the drawings, in which.

Figure 1:
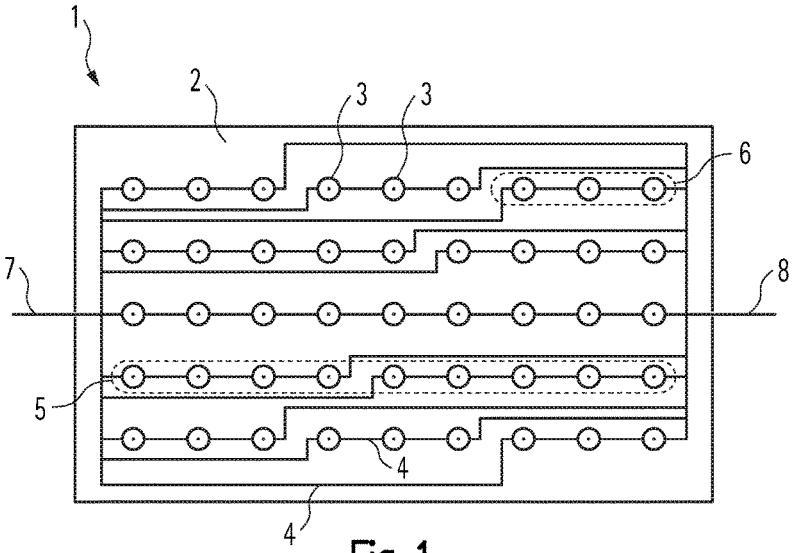
FIG. 1 shows a schematic diagram of an LED module according to the invention in accordance with a first exemplary embodiment.

FIG. 1 shows a schematic diagram of an LED module 1 according to the invention in accordance with the first exemplary embodiment, consisting of an elongate planar carrier or a circuit board 2 and LEDs 3 arranged thereon in a uniform grid, said LEDs being interconnected via electrically conductive connections 4 to form a parallel circuit of eleven series circuits 6. In this case, the uniform grid is formed from five rows 5 each having nine LEDs 3. All the LEDs 3 are furthermore preferably substantially identical in terms of at least their forward voltage, particularly preferably identical in terms of all their properties, wherein with regard to the forward voltage this should be understood to the effect that the deviations from one another should be if possible less than 0.1 V.

According to the invention, the interconnection of the LEDs 3 is now embodied in such a way that the greatest number of LEDs 3 per series circuit 6 is in the central or middle row on the carrier 2, and that this number becomes smaller, the further away a row 5 under consideration is from the center or center axis. This is evident in this exemplary embodiment specifically by virtue of the fact that—counted from the top downward—the first row 5 has three series circuits 6 each having three LEDs 3, the second row 5 has two series circuits 6 having respectively five and four LEDs 3, and the third row, which at the same time is situated the most centrally, has one series circuit 6 having nine LEDs 3. A directly resulting consequence is, therefore, that in the case of an interconnection in accordance with this first exemplary embodiment, in principle, the number of series circuits 6 or LED strings 6 required is ultimately greater than the number of LED rows 5 arranged on the carrier 2.

For operation of the LED module 1, a voltage—made available by an operating device (not illustrated)—is applied between the common end points 7 and 8 of all the electrically conductive connections 4. Since all the series circuits 6 are supplied with the same voltage during operation, the LEDs 3 in the series circuits 6 in the edge region of the carrier 2 are individually under increased voltage load and thus increased current load on account of their smaller number per series circuit 6. Consequently, the main foci of the current load of all the LEDs 3 are transferred to the outer regions of the carrier 2. This results in the desired effect that now the main foci of the generation of heat are also transferred to the outer regions of the carrier 2 and the thermal loading of the central regions of the carrier 2 is thus relieved.

It should be clarified at this juncture that FIG. 1 serves primarily for the basic illustration of the concept according to the invention, namely of using LED strings each having different numbers of LEDs. In reality, the numbers of LEDs will deviate from one another to a lesser extent than is illustrated in FIG. 1. In this regard, by way of example, one concrete embodiment would be conceivable in which three LED strings are provided, wherein the middle string consists of 21 LEDs and the two outer strings each have 18 LEDs.

Moreover, it would also be conceivable for an LED string to extend over a plurality of rows of the LED circuit board in order to obtain a uniform grid arrangement of LEDs.

In the abovementioned example with three LED strings, e.g. the respective last LEDs of the middle string (having 21 LEDs) could be arranged in the outer rows, thus resulting in a uniform LED grid having 3×19 LEDs. Despite everything, heat is generated primarily in the lateral regions in order to be able to achieve the sought aim of uniform thermal loading.

Figure 2:
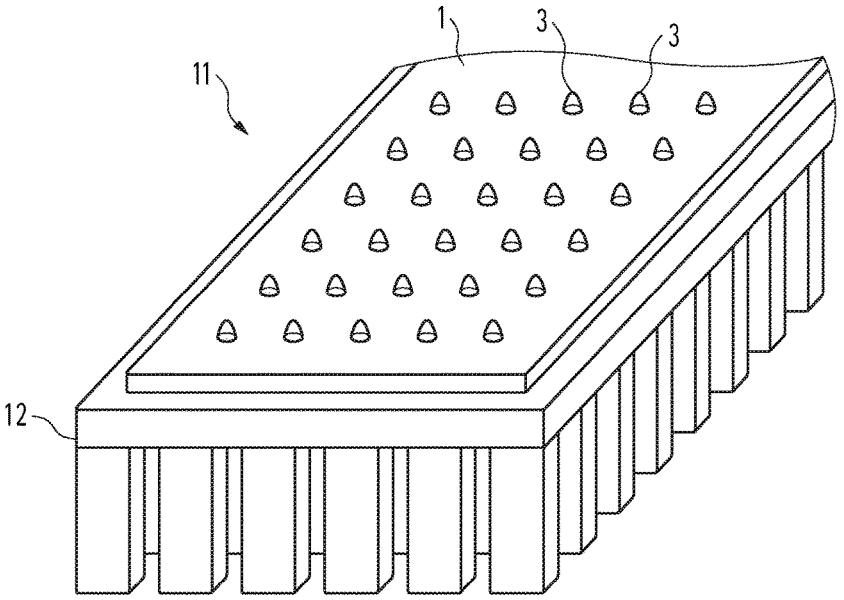
FIG. 2 shows a perspective schematic diagram of the LED module from FIG. 1 coupled to a heat sink.

FIG. 2 illustrates how an arrangement 11 for cooling such an LED module 1 according to the invention, as illustrated in FIG. 1, is made possible. The LED module 1, at its underside, for example, is fixed on a heat sink 12 or is coupled thereto, the fixing means not being visible in FIG. 2. In the present case, it is assumed that the LED module 1, on account of the configuration according to the invention, is subjected to uniform thermal loading during operation even without cooling measures, which has the consequence that the heat sink 12 does not require any further or more specific cooling measures below the center of the LED module 1 in the arrangement 11 than at the edge of the heat sink 12. In other words, the fact of the thermal loading being made more uniform according to the invention is achieved solely by the configuration of the LED module 1, such that the thermal loading overall can be reduced further by the use of the heat sink 12, without the heat sink having to be designed in any special way.

Figure 3:
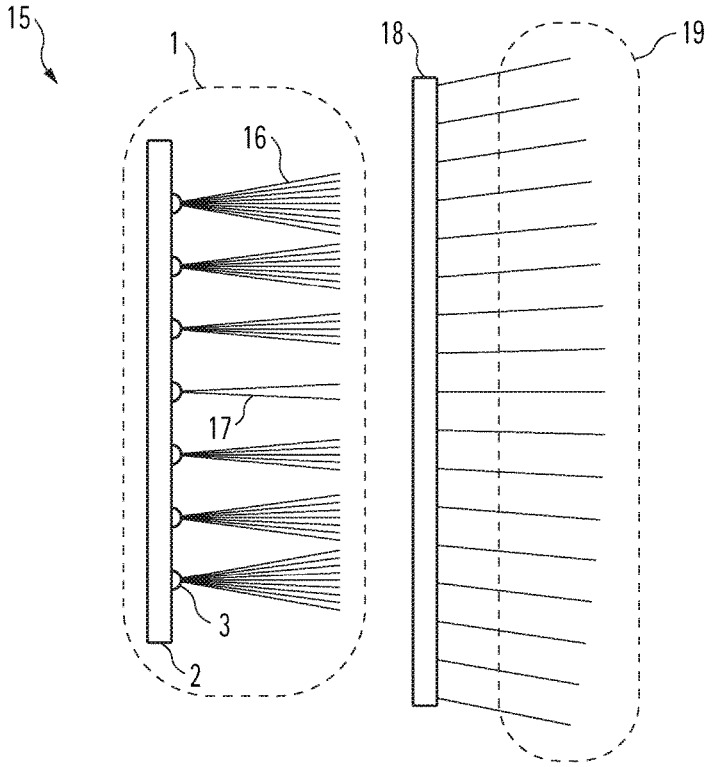
FIG. 3 shows a cross-sectional schematic diagram of an arrangement for light emission consisting of the LED module and an optical diffuser plate and FIG. 4 shows a schematic diagram of the LED module in accordance with a second exemplary embodiment.

FIG. 3 shows a cross-sectional schematic diagram of an arrangement 15 for light emission, consisting of LED module 1 according to the invention in operation and an optical diffuser plate 18. The LED module 1 and the diffuser plate 18 are arranged substantially parallel to one another at a specific distance. The drawing additionally illustrates the fact that the LEDs 3 in the edge region of the carrier 2, on account of the higher current load, emit more light than the LEDs 3 in the central region, which has the consequence that the radiance 16 at the edge is greater than the radiance 17 in the center. The diffuser plate can now be designed to homogenize or make more uniform the light of the LED module 1 in the emission direction, which is characterized by the uniform radiance 19.

Alternatively, it can even be advantageous that the LEDs 3 in an edge region of the carrier 2 emit more light than the LEDs 3 in the central region. Usually, in lighting assemblies, a plurality of LED modules 1 are arranged alongside one another on a preferably planar surface in combination with an optical diffuser plate 18 preferably in accordance with FIG. 3. Usually, the distance between the LED modules 1 among one another is also greater than the distance between the LED rows among one another on a module, which would have the consequence that in the case of light emission of all the LEDs 3 being—assumed to be—of the same intensity, the regions between the LED modules 1 would appear to be less bright than the more central regions of the LED modules 1. This effect is now automatically compensated for with the aid of the LED modules 1 according to the invention by virtue of the fact that the LEDs 3 in the edge regions of the respective LED modules 1 are more brightly luminous on account of the higher current load, which leads overall to a significantly more homogeneous appearance of the brightness distribution. The optical diffuser plate 18 then also additionally provides for better homogenization.

Figure 4:
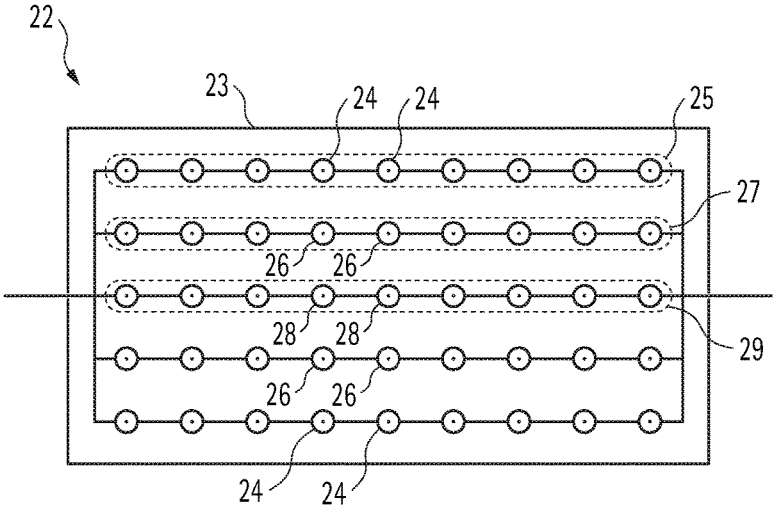

FIG. 4 shows a schematic diagram of an LED module 22 according to the invention in accordance with a second exemplary embodiment, analogous to the LED module 1 according to variant 1 from FIG. 1. One of the major differences between the LED module 1 from FIG. 1 and the LED module 22 from FIG. 4 here is that different LEDs that differ in terms of their forward voltage are used in the case of the LED module 22. LEDs having different forward voltages are identified by the numerals 24, 26 and 28, wherein identical numerals denote identical forward voltages. However, each LED row 25, 27 or 29 preferably has in each case only LEDs having identical forward voltages, that is to say that, within a row, the deviations in the forward voltages are less than 0.1 V, as already mentioned. The differences in the forward voltages between the different LED rows 25, 27, 29, however, should preferably be at least 0.1 V.

The second major difference is that each series circuit has the same number of LEDs in the case of the module from FIG. 4. This has the consequence that the number of LED rows corresponds to the number of series circuits. Furthermore, the electrical interconnection is no longer asymmetrical, as was the case in the LED module 1 from FIG. 1.

The complete arrangement of the LEDs and electrical connections on the carrier 23 is expediently placed axially symmetrically around the LED row 29 in order not to cause any asymmetry of the thermal loading of the carrier 23 during operation, even if the total thermal loading of the carrier would not be uniform. The carrier 23 from FIG. 4 and the carrier 2 from FIG. 1 need not necessarily be different.

The forward voltages of the LEDs 24 in the outer row 25 are chosen such that they are less than the forward voltages of the LEDs 26 in row 27. Analogously, the forward voltages of the LEDs 26 in row 27 should be chosen such that they are less than the forward voltages of the LEDs 28 in row 29. The same correspondingly applies to the rest of the rows (not designated by reference numerals) in the lower part of the LED module 22 by means of axial mirroring of all properties at the row 29. On account of the lower forward voltages in the direction of the outer region of the carrier 23, it is thus ensured that a higher current flow is present in the corresponding LEDs, that is to say that main foci of the current load or thermal load are transferred to the edge regions of the carrier 23.

The use of LEDs having different forward voltages is made possible for example by taking LEDs of identical type which, however, nevertheless have different forward voltages during production. Optionally, the use of totally different LED types is also possible.

As already mentioned, the two concepts for better distribution of the thermal loading can also be combined with one another. In this case, different LEDs are then used on the module and the lengths of the LED series circuits are varied.

It goes without saying that the LED module illustrated in FIG. 4, in a manner analogous to that for the module in accordance with FIG. 1, can be combined with heat sinks or optical elements. In the illustrations in FIG. 2 and FIG. 3, therefore, the LED module 1 can readily be replaced by the LED module 22.

To summarize, therefore, the use of an LED module according to the invention affords the possibility of saving costs that arise as a result of the use of cooling measures. Furthermore, by optimizing the distribution of the thermal loading, it is possible to prolong the lifetime of LEDs and to obtain more homogeneous appearances with regard to the light emission within and/or outside lighting devices which contain an LED module according to the invention.

The invention claimed is:

1. An LED module, comprising an arrangement of electronically interconnected LEDs and a carrier for the LEDs, wherein a parallel circuit formed by a plurality of series circuits of LEDs, wherein the parallel circuits are arranged in such a way that the thermal loading of the carrier caused by the operation of the LEDs is distributed substantially uniformly over the carrier;

wherein the arrangement of the LEDs forms a uniform grid;

wherein all the LEDs on the carrier are substantially identical and uniformly arranged on the carrier in rows; wherein the rows located in an outer or edge region of the carrier comprises a greater number of series circuits than a row located in an inner or central region of the carrier;

and wherein the number of LEDs in a series circuit located in the outer or edge region of the carrier is less than the number of LEDs of a series circuit located in the inner or central region, such that during operation the LEDs of a series circuit from an outer or edge region of the carrier are subjected to a greater current load than the LEDs of a series circuit from an inner or central region.

2. An arrangement for light emission, consisting of an LED module as claimed in claim 1 and an optical device, wherein the optical device is designed substantially to homogenize or to make more uniform the light emitted by the LED module during operation.

3. The arrangement as claimed in claim 2, wherein it comprises a plurality of LED modules arranged alongside one another.

4. The LED module as claimed in claim 1, where all of the series circuits are arranged in parallel and are connected to a common voltage source.

* * * * *